US006000509A

United States Patent [19]

Chisholm

[11] Patent Number: 6,000,509

[45] Date of Patent: Dec. 14, 1999

[54] COMPARTMENTED SUITCASE

[75] Inventor: Claudia Chisholm, Northbrook, Ill.

[73] Assignee: Kingport International Corporation, Evanston, Ill.

[21] Appl. No.: 08/978,750

[22] Filed: Nov. 26, 1997

[51] Int. Cl.[6] ..... A45C 3/00; A45C 5/12; A45C 13/02

[52] U.S. Cl. ..... 190/109; 190/110; 190/112; 150/113

[58] Field of Search ..... 190/108, 110, 190/111, 112; 150/111, 113, 117; 206/320

[56] References Cited

U.S. PATENT DOCUMENTS

| | | | |
|---|---|---|---|
| 767,898 | 8/1904 | Lamphier | 190/110 X |
| 1,752,948 | 4/1930 | Herrmann | 190/108 |
| 2,131,583 | 9/1938 | Crotty et al. | 190/111 X |
| 2,612,199 | 9/1952 | Schocket | 150/111 X |
| 4,386,642 | 6/1983 | Durbin | 190/110 |
| 4,483,427 | 11/1984 | Gerch | 190/112 X |
| 4,506,769 | 3/1985 | Franco et al. | 190/112 X |
| 4,854,431 | 8/1989 | Pulichino, Jr. et al. | 190/112 X |
| 4,854,432 | 8/1989 | Carpenter et al. | 190/110 |
| 4,874,119 | 10/1989 | Winter | 190/110 X |
| 4,887,751 | 12/1989 | Lehman | 190/110 X |
| 4,925,021 | 5/1990 | Pulichino, Jr. | 190/112 X |
| 4,960,204 | 10/1990 | Young et al. | 190/111 X |
| 5,054,589 | 10/1991 | Bomes et al. | 190/112 X |
| 5,096,030 | 3/1992 | Espinosa et al. | 190/108 |
| 5,207,303 | 5/1993 | Oswalt et al. | 190/108 |
| 5,431,265 | 7/1995 | Yoo | 190/109 X |
| 5,515,954 | 5/1996 | Nordstrom | 190/115 X |
| 5,524,754 | 6/1996 | Hollingsworth | 206/320 |
| 5,676,223 | 10/1997 | Cunningham | 190/112 X |
| 5,678,666 | 10/1997 | Shyr et al. | 190/108 X |
| 5,732,817 | 3/1998 | Plath | 190/109 X |

FOREIGN PATENT DOCUMENTS

| | | | |
|---|---|---|---|
| 9008631 | 8/1990 | WIPO | 190/112 |

*Primary Examiner*—Sue A. Weaver
*Attorney, Agent, or Firm*—Hill & Simpson

[57] ABSTRACT

A suitcase is provided having compartments for storing various types of articles in the distinct compartments. Preferably, the compartments are implemented to store in one compartment toiletries and/or cosmetics and, in the other compartment, articles of clothing or the like. In one of the compartments, removable inserts are provided having separate sub-compartments or fastening mechanisms for holding various articles and the like. The inserts are removable from the compartment and include straps for hanging the same for ready access to the articles held by the insert.

10 Claims, 6 Drawing Sheets

COMPARTMENTED SUITCASE

BACKGROUND OF THE INVENTION

The present invention generally relates to a suitcase for holding and transporting clothing and/or other articles. More specifically, the present invention relates to a suitcase, particularly useful for separating certain types of articles from other types of articles within interior compartments of the suitcase.

It is, of course, generally known to provide suitcases with separate compartments. Typically, one large compartment forms an interior of the suitcase. Often, many sub-compartments are formed within the large compartment. However, oftentimes, it is desirable to separate certain articles from other articles. One specific example of such articles is cosmetics and toiletries. Often, these articles can be cumbersome to carry within a suitcase, take up a great deal of space, and often are messy and may spill on or otherwise stain other articles within the interior of the suitcase.

Moreover, it is often difficult to pack cosmetics and toiletries within a suitcase and have those products readily available for use when needed.

A need, therefore, exists for an improved suitcase with separate compartments for various types of articles. In addition, a need exists for a suitcase directed to holding articles, such as cosmetics and toiletries, separately from a remainder of the articles within the interior of the suitcase.

SUMMARY OF THE INVENTION

The present invention provides a suitcase having interior compartments capable of carrying different items or articles within the separate compartments. Moreover, the present invention provides a suitcase having a separate section for articles such as cosmetics and/or toiletries, such that the articles may be maintained in an isolated relationship with respect to other items carried in the suitcase.

To this end, in an embodiment of the present invention, a suitcase is provided. The suitcase has a first compartment that defines a first interior. A second compartment defines a second interior wherein the first compartment is integrally formed with the second compartment and further wherein the first compartment and the second compartment have a common wall between the first compartment and the second compartment. A first fastener provides access to the first compartment and a second fastener provides access to the second compartment.

In an embodiment, the first compartment and the second compartment are substantially equal in height and width.

In an embodiment, the depth of the first compartment is substantially greater than the depth of the second compartment.

In an embodiment, a first insert is attachable to a first interior wall of the second compartment.

In an embodiment, a second insert is attachable to a second interior wall of the second compartment.

In an embodiment, a plurality of sub-compartments are integrally formed on a wall of the first insert.

In an embodiment, a fastener is provided between the first insert and the first interior wall.

In an embodiment, a strap extends from the first insert.

In an embodiment, a plurality of attachment means are integrally formed on a wall of the first insert.

In an embodiment, a plurality of sub-compartments are integrally formed on a wall of the second compartment.

In an embodiment, a fastener is provided between the second interior and the second insert.

In an embodiment, a strap extends from the second insert.

In another embodiment of the present invention, a cosmetic holder and suitcase are provided, in combination. The combination has a first compartment and a second compartment. A first fastener formed in a peripheral wall of the first compartment provides selective access to the first compartment. A second fastener formed in a peripheral wall of the second compartment provides selective access to the second compartment. A removable insert is attached to an interior wall of the first compartment.

In an embodiment, a second removable insert is attached to another interior wall of the first compartment.

In an embodiment, a plurality of sub-compartment are integrally formed on a wall of the removable insert.

In an embodiment, a fastener is provided between the removable insert and the wall of the first compartment.

In an embodiment, a strap extends from the removable insert.

In an embodiment, the first compartment and the second compartment include a common wall that defines a length and width of each of the first compartment and the second compartment.

In an embodiment, an interior volume of the second compartment is substantially greater than an interior volume of the first compartment.

In an embodiment, a fastener is provided between the second removable insert and the another interior wall of the first compartment.

It is, therefore, an advantage of the present invention to provide a suitcase having compartments for specific types of articles.

Another advantage of the present invention is to provide a suitcase having at least one compartment that simplifies carrying of articles, such as toiletries and cosmetics.

And, another advantage of the present invention is to provide a suitcase having easily accessible compartments with distinct items carried therein.

Yet another advantage of the present invention is to provide a suitcase having removable inserts contained within a compartment.

A still further advantage of the present invention is to provide a suitcase having a separate compartment having removable inserts having sub-compartments for holding a variety of articles, such as cosmetics and/or toiletries.

Moreover, a still further advantage of the present invention is to provide a suitcase having a plurality of compartments wherein removable inserts are contained within one of the compartments wherein the removable inserts may be separately suspended for ready access to the components held by the removable insert.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a suitcase. More specifically, the present invention relates to a multi-compartmented suitcase, particularly useful for holding distinct types of goods therein. In particular, one compartment is suitable for holding cosmetics and/or toiletries separately from another compartment that may be implemented for holding, for example, clothing or other articles typically required for travel by an individual, such as weekend travel, business travel, overnight travel, or the like.

Figure 1:
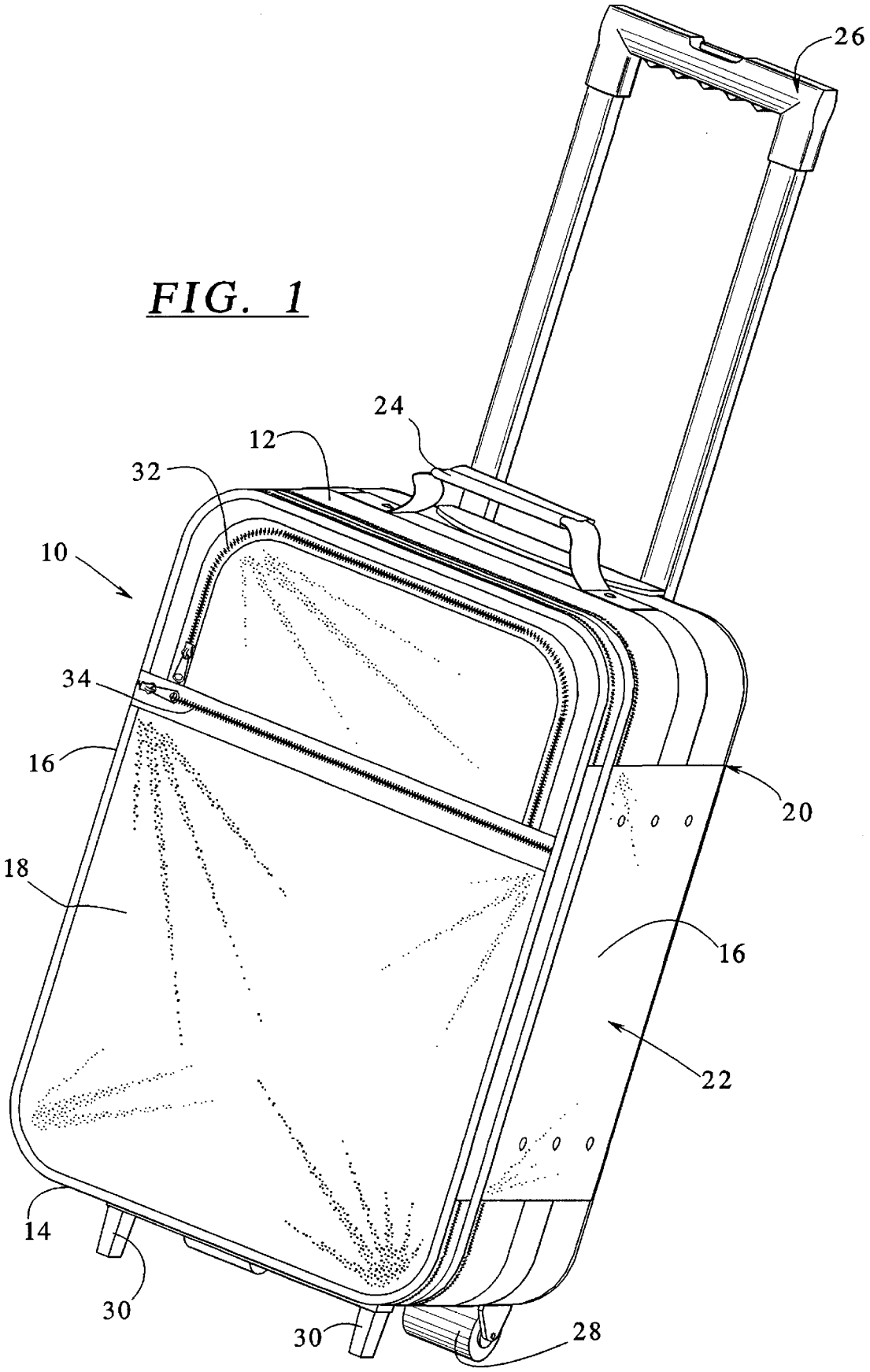
FIG. 1 illustrates a front perspective view of an embodiment of a suitcase of the present invention.

Referring now to the drawings wherein like numerals refer to like parts, FIG. 1 generally illustrates a suitcase 10. The suitcase 10 may be constructed in a generally rectangular shape and may have a soft side or hard side construction or a combination of both. As shown, the suitcase 10 has a top wall 12, a bottom wall 14, sidewalls 16, a front wall 16 and a back wall 20. Preferably, at least the top wall 12 and the bottom wall 14 are reinforced to provide durable, more rugged surfaces at each end. Further, preferably, one of the side walls 16 is provided with a reinforced surface 22 for extra wear or abuse that may be placed on one of the side walls 16. Of course, the entire periphery of walls may be reinforced as desired.

Figure 2:
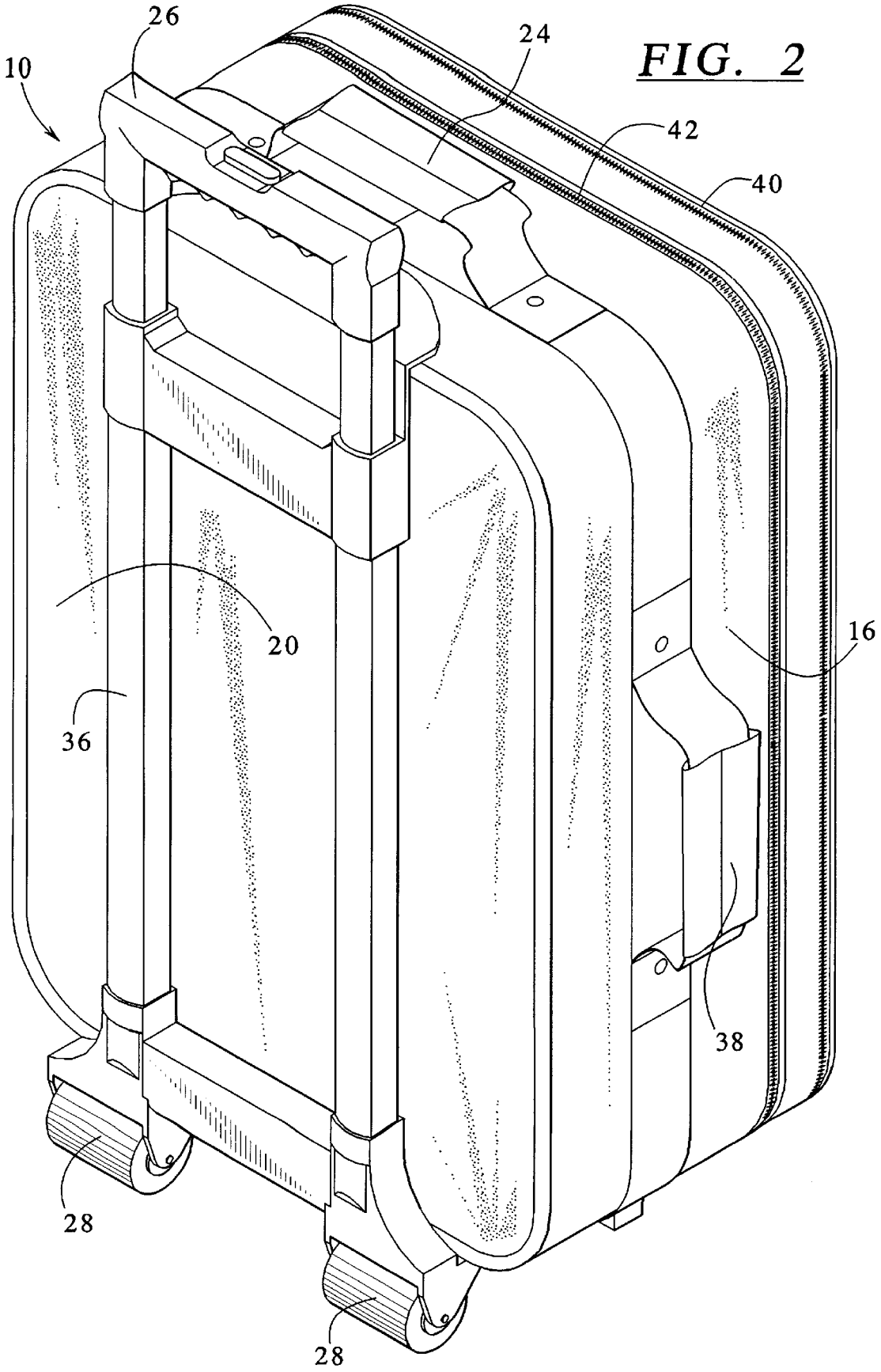
FIG. 2 illustrates a rear perspective view of an embodiment of a suitcase of the present invention.

As shown, the suitcase 10 includes a handle 24 as well as an extendible handle 26. The extendible handle 26 is particularly useful in conjunction with wheels 28 connected to the bottom wall 14 of the suitcase 10 or integrally connected as shown in FIG. 2 as a separate unit attachable to the back wall 20 of the suitcase 10. Also, feet 30 may be provided as extensions to the bottom wall 14 of the suitcase 10 such that the suitcase 10 may be stood in a level orientation when not in use. As further illustrated in FIG. 1, fasteners 32 and 34 are provided allowing access to sub-compartments formed on a wall of the suitcase 10.

FIG. 2 illustrates a rear view of the suitcase illustrated in FIG. 1 showing the handle assembly 36 connected to the back wall 20 of the suitcase 10. Although the present invention, in a preferred embodiment, includes the handle assembly 36 allowing for wheeled transport of the suitcase 10, it should be understood that other types of handle and wheel assemblies may be implemented by those skilled in the art. Additionally, the suitcase 10 of the present invention may, of course, be implemented without the extendible handle 26 and/or the wheels 28.

As shown in FIG. 2, a second handle 38 may also be provided attached to the side wall 16 of the suitcase 10. The handles 24 and 38 in conjunction with the extendible handle 26 provide various options for transporting the suitcase 10. As more clearly illustrated in FIG. 2, additional fasteners 40,42 are provided around a periphery of the suitcase 10 in order to provide access to compartments of the suitcase 10 as generally illustrated and as will be further described with reference to FIGS. 3 and 4.

Figure 3:
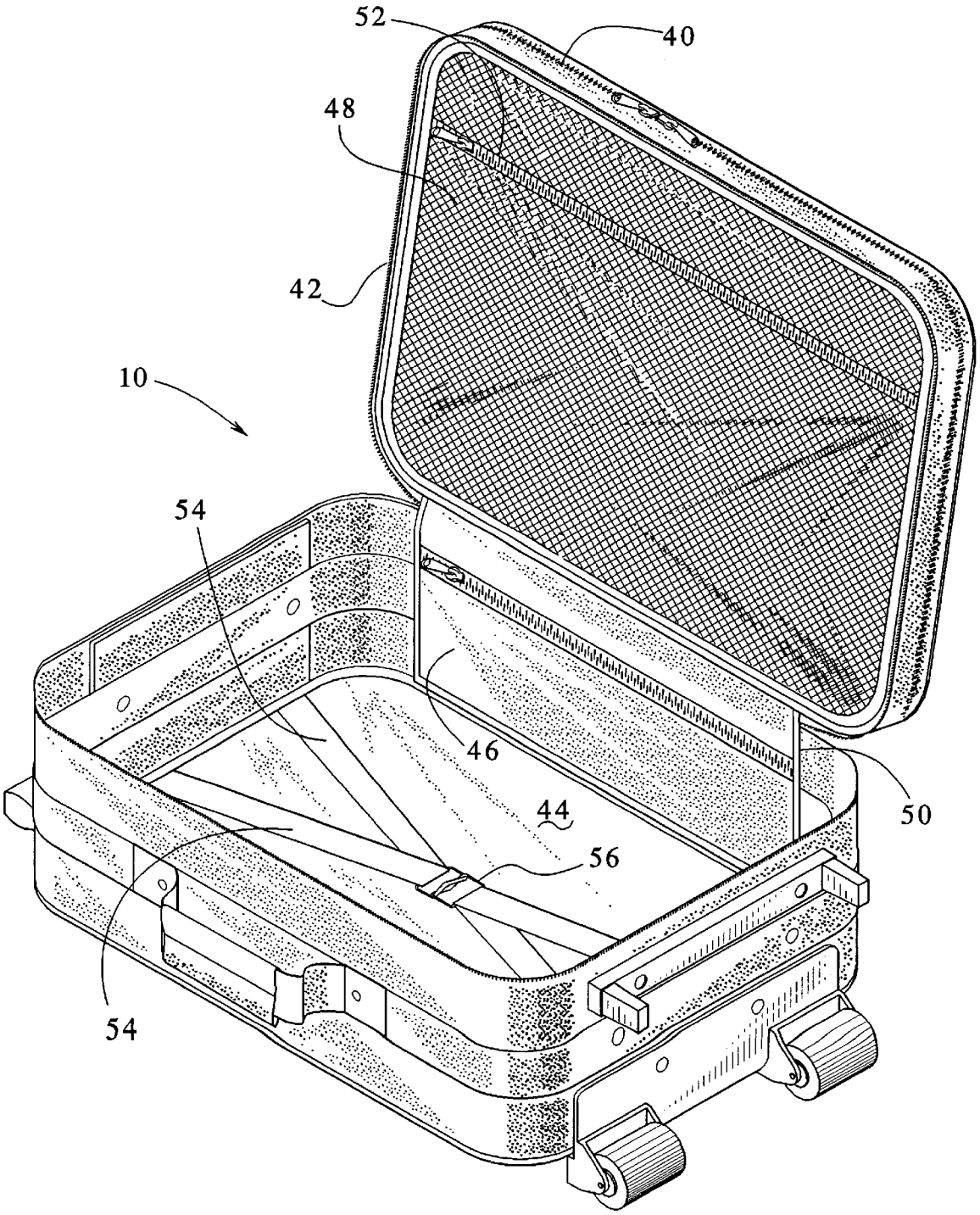
FIG. 3 illustrates a perspective view of an embodiment of a suitcase of the present invention with one of the compartments exposed.

Referring now to FIG. 3, a first compartment 44 is accessible by opening of the fastener 42 to expose the first compartment 44. Within the compartment 44, sub-compartments may be provided such as a side pocket 46 and a meshed wall compartment 48 each accessible via fasteners 50,52. As shown, the interior of the compartment 44 may also include straps 54. The straps 54 may hold or contain articles within the compartment 44. Preferably, the straps 54 are elastic such that the straps may be released at, for example, a buckle 56 and stretched or otherwise secured around articles placed thereunder. Of course, many other arrangements of sub-compartments and other accessories for holding or otherwise securing articles within the compartment 44 are contemplated, and the present invention should not be construed as limited to a specific arrangement within the compartment 44.

Figure 4:
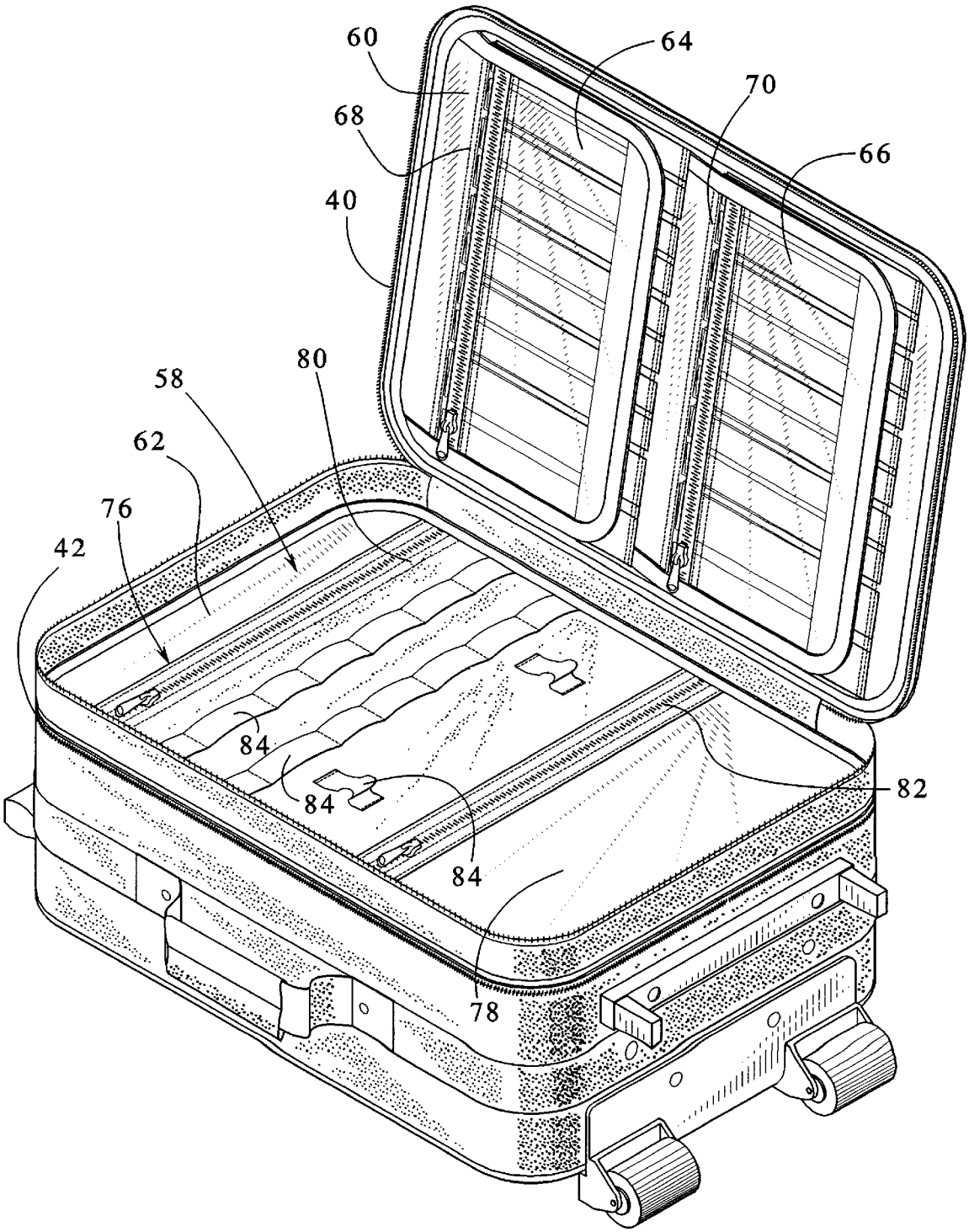
FIG. 4 illustrates a perspective view of an embodiment of the suitcase of the present invention with another compartment of the suitcase exposed.

Referring now to FIG. 4, a second compartment 58 is accessible by releasing the fastener 40 as illustrated. Within the second compartment, preferably, on each wall, removable inserts 60, 62 are provided. The removable inserts 60,62 are attached to the interior walls of the second compartment 58 such that the inserts 60,62 may be removed and separately accessed. The removable insert 60 may include a variety of sub-compartments accessible through various fasteners as generally illustrated.

Figure 6:
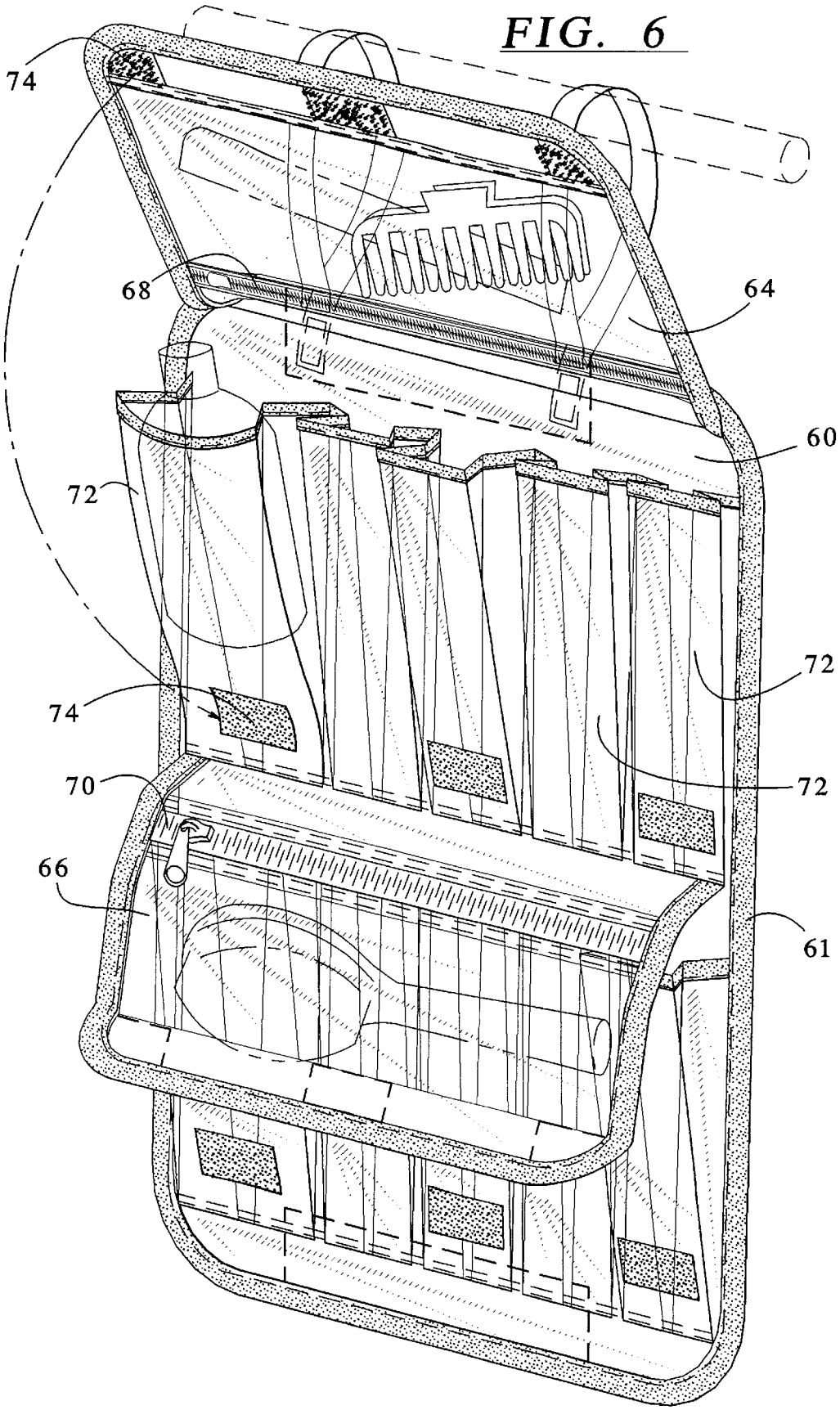
FIG. 6 illustrates a perspective view of an insert of the present invention removed from a compartment and suspended on a rod for access to the articles held by the insert.

For example, the removable insert 60, more clearly illustrated in FIG. 6, may include a first sub-compartment 64 and a second sub-compartment 66. The sub-compartments 64,66 may be accessible via fasteners 68,70, respectively. In addition, the first and second sub-compartments 64,66 may be lifted with respect to a remainder of the removable insert 60 as shown in FIG. 6 so as to access additional sub-compartments 72 beneath the first sub-compartment 64. The first sub-compartment 64 may also be secured to enclose the additional sub-compartment 72 via complementary hook and loop fasteners 17 as generally illustrated in FIG. 6.

Of course, other arrangements of removable inserts 60 may be implemented by those skilled in the art. For example, the removable insert 62 as shown in FIG. 4 may include sub-compartments 76,75 that may be accessible through fasteners 80,82, respectively. In addition, elasticized bands 84 may be provided to hold or secure articles between the elasticized band 84 and the wall of the insert 62. Like the insert 60, the insert 62 may be removably secured to an interior wall of the second compartment 58.

Figure 5:
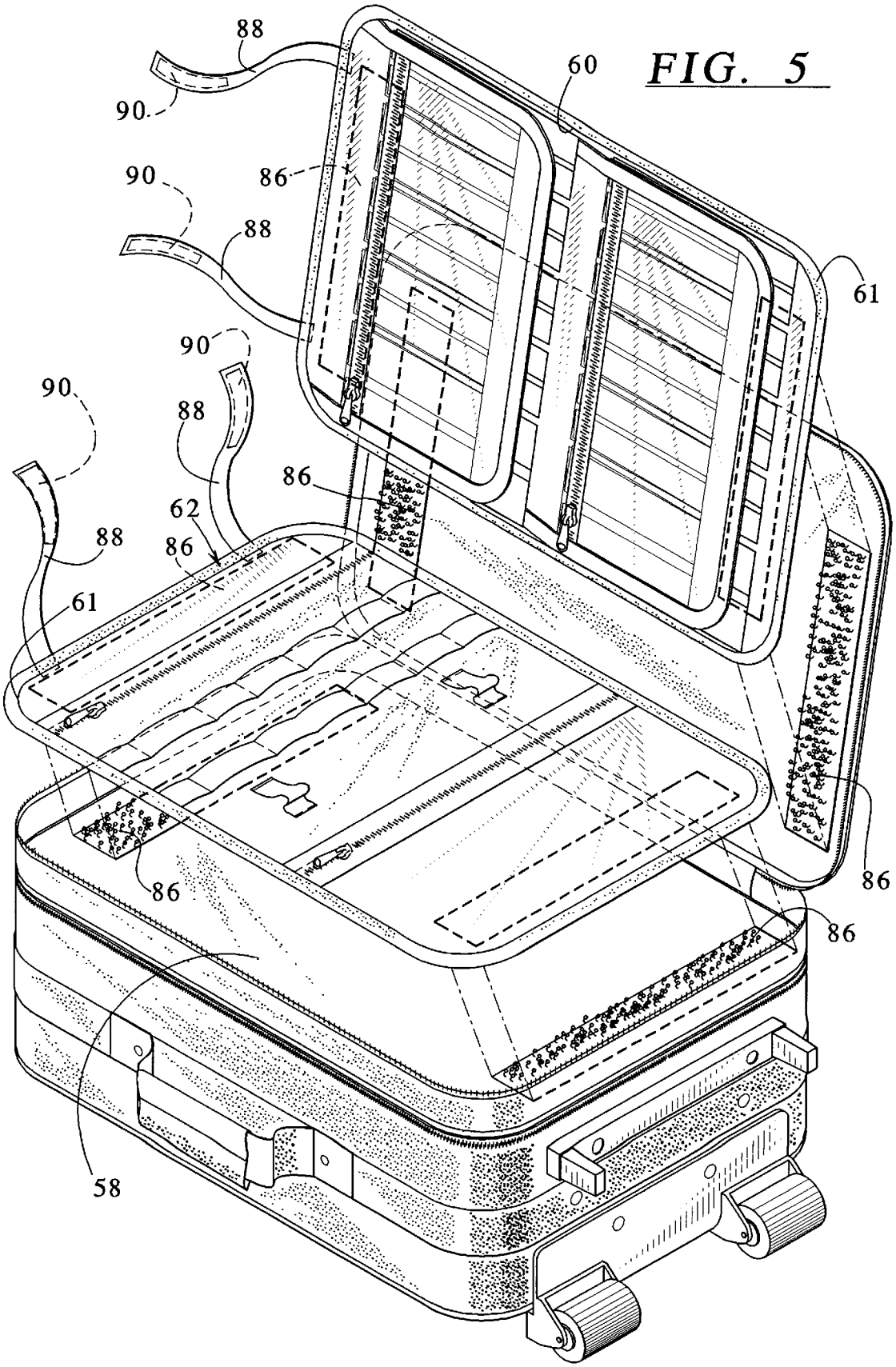
FIG. 5 illustrates a perspective view of an embodiment of the suitcase of the present invention with removable inserts detached from a compartment of the suitcase.

As shown in FIG. 5, the removable inserts 60,62 are attachable to the interior walls of the compartment 58 by complimentary hook and loop fasteners 86. As further shown in FIGS. 5 and 6, straps 88 may be provided and attached to each of the inserts 60,62 as illustrated. In use, the straps 88 incorporate a complimentary fastener 90 to the fastener 86 provided on a back side of the removable inserts 60,62 such that the straps 88 may be looped over, for example, a rod, and the insert 60 or 62 may be suspended from the rod as generally illustrated in FIG. 6 for the insert 60. To this end, the article within the various compartments and sub-compartments of the insert may be easily and readily accessed by a user. For example, the straps 88 may be secured around a towel bar in a shower for ready access to the necessary toiletries and other articles contained within the various compartments of the removable inserts 60,62.

The compartments and/or the removable inserts 60,62 may be constructed of water-resistant or water-repellant materials such that use of the inserts 60,62 within environments in which water may be splashed or otherwise contacted onto the removable insert 60,62 does not damage the same. In addition, preferably, the removable inserts 60,62 are constructed of a durable material attached to a frame 61 such that the removable inserts 60,62 maintain a defined rigid shape. The frame 61 may be, for example, a heavier gauge wire that extends around the outer periphery of each of the inserts 60,62 to maintain each insert 50,62 in a planar, but bendable, state.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A suitcase comprising:

a first compartment defining a first interior and comprising a first outer wall;

a second compartment defining a second interior wherein the first compartment is integrally formed with the second compartment and wherein the first compartment and the second compartment share a common wall that separates the first compartment from the second compartment, the common wall comprising a first side that faces the first compartment and a second side that faces the second compartment, the common wall defining a common length and a common width of the first and second compartments, the second side of the common wall being detachably connected to a first insert, the second compartment comprising a second outer wall disposed opposite the second side of the common wall, the outer wall having an inner side that is detachably connected to a second insert;

a first fastener disposed between the first side of the common wall and the first outer wall, the first fasterner providing access to the first compartment; and a second fasterner disposed between the second side of the common wall and the second outer wall, the second fastener providing access to the second compartment, the common wall being fixedly attached to a peripheral portion of the suitcase disposed between the first and second fasteners, the first and second inserts each comprising a plurality of sub-compartments.

2. The suitcase of claim 1 wherein the first compartment and the second compartment are substantially equal in height and width.

3. The suitcase of claim 1 wherein depth of the first compartment is substantially greater than depth of the second compartment.

4. The suitcase of claim 1 further comprising:

a strap extending from the first insert.

5. The suitcase of claim 1 further comprising:

a plurality of attachment means integrally formed on a wall of the first insert.

6. The suitcase of claim 1 further comprising:

a strap extending from the second insert.

7. The suitcase of claim 1 wherein the first and second inserts each comprise a plurality of components.

8. A compartmented suitcase comprising, in combination:

a first compartment having a first outer wall;

a second compartment having a second outer wall;

a common wall disposed between and separating the first and second compartments, the common wall defining a common length and common width of the first and second compartments;

a first fastener formed in a peripheral wall of the first compartment between the common wall and the first outer wall, the first fastener providing selective access to the first compartment;

a second fastener formed in a peripheral wall of the second compartment between the common wall and the second outer wall, the second fastener providing selective access to the second compartment;

the common wall comprising a first side facing the first compartment and a second said facing the second compartment, the second outer wall disposed opposite the second side of the common wall, the second outer wall having an inner side;

a removable first insert attached to the second side of the common wall, a removable second insert attached to the inner side of the second outer wall;

the common wall being fixedly attached to a peripheral portion of the suitcase disposed between the first and second fasteners, the first and second inserts each comprising a plurality of sub-compartments.

9. The combination of claim 8 further comprising:

a strap extending from the removable first insert.

10. The combination of claim 8 wherein an interior volume of the second compartment is substantially greater than an interior volume of the first compartment.

* * * * *